US009618899B2

(12) United States Patent
Fukase

(10) Patent No.: US 9,618,899 B2
(45) Date of Patent: Apr. 11, 2017

(54) IMAGE FORMING APPARATUS HAVING A FIRST UNIT WHICH IS MOVED INTERRELATEDLY WITH A SECOND UNIT VIA AN URGING PORTION

(71) Applicant: CANON KABUSHIKI KAISHA, Tokyo (JP)

(72) Inventor: Yasuhiro Fukase, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/073,873

(22) Filed: Mar. 18, 2016

(65) Prior Publication Data

US 2016/0202659 A1 Jul. 14, 2016

Related U.S. Application Data

(62) Division of application No. 14/607,371, filed on Jan. 28, 2015, now Pat. No. 9,323,212.

(30) Foreign Application Priority Data

Jan. 31, 2014 (JP) ..... 2014-017337

(51) Int. Cl.
*G03G 21/16* (2006.01)

(52) U.S. Cl.
CPC ..... *G03G 21/1647* (2013.01); *G03G 21/1633* (2013.01)

(58) Field of Classification Search
CPC ..... G03G 21/1647; G03G 21/1633; G03G 2215/00544
See application file for complete search history.

(56) References Cited

U.S. PATENT DOCUMENTS

| | | | | |
|---|---|---|---|---|
| 5,802,426 | A | 9/1998 | Miyazaki et al. | |
| 5,839,032 | A | 11/1998 | Yasui et al. | |
| 7,386,255 | B2 | 6/2008 | Ochi | |
| 8,923,746 | B2 | 12/2014 | Nakamura et al. | |
| 9,323,212 | B2 * | 4/2016 | Fukase | G03G 21/1647 |
| 2005/0036804 | A1 | 2/2005 | Yokoi | |

FOREIGN PATENT DOCUMENTS

| | | | |
|---|---|---|---|
| JP | 2004-20574 | A | 1/2004 |
| JP | 2010-286658 | A | 12/2010 |
| JP | 2012-194589 | A | 10/2012 |
| JP | 2013-228655 | A | 11/2013 |

* cited by examiner

*Primary Examiner* — Sandra Brase
(74) *Attorney, Agent, or Firm* — Fitzpatrick, Cella, Harper & Scinto

(57) ABSTRACT

An image forming apparatus includes a main assembly, a first unit openable relative to the main assembly, and a second unit which is provided inner than the first unit and which is openable relative to the main assembly. Two engaging portions are provided on the second unit for placing the second unit in a closed state in engagement with the main assembly. An urging portion is provided in the first unit for urging the second unit. The second unit is urged by the urging portion of the first unit so that a state of the second unit is capable of being changed from an open state to the closed state. The urging portion urges a region in a neighborhood of a central portion of the second unit with respect to a direction of arrangement of the two engaging portions.

16 Claims, 16 Drawing Sheets

(a)

| FORM | URGING PORTION | PORTION-TO-BE-URGED | NOOSES / NOCO |
|---|---|---|---|
| FORM 1 | P1L, P1R | TL | 0/20 |
| | | TC | 0/20 |
| | | TR | 0/20 |
| FORM 2 | P2L, P2R | TL | 20/20 |
| | | TC | 0/20 |
| | | TR | 15/20 |

(b)

IMAGE FORMING APPARATUS HAVING A FIRST UNIT WHICH IS MOVED INTERRELATEDLY WITH A SECOND UNIT VIA AN URGING PORTION

This application is a divisional of application Ser. No. 14/607,371, filed on Jan. 28, 2015.

FIELD OF THE INVENTION AND RELATED ART

The present invention relates to an image forming apparatus, such as a copying machine or a printer, having a function of forming an image on a recording material such as a sheet.

In a color image forming apparatus of an electrophotographic type, two types consisting of a type in which a toner image is directly transferred from an image bearing member onto a recording material (media) and a type in which the toner image is primary-transferred from the image bearing member onto an intermediary transfer member and then is secondary-transferred from the intermediary transfer member onto the recording material go mainstream. In the type in which the toner image is directly transferred from the image bearing member onto the recording material, an electrostatic attraction belt is used for feeding the recording material in many cases, and in the type in which the toner image is secondary-transferred from the intermediary transfer member onto the recording material, an intermediary transfer belt is used in many cases. In the secondary transfer onto the recording material, in many cases, a constitution in which the recording material is fed by a secondary transfer roller while performing secondary transfer in a state in which the recording material is sandwiched between the secondary transfer roller and a secondary transfer opposite roller for stretching the intermediary transfer member is employed.

With respect to the secondary transfer roller, a secondary transfer unit integrally assembled with feeding paths before and after a secondary transfer device is made rotatable (openable) relative to the intermediary transfer member in order to realize clearance of a jam of the recording material (sheet) and ease of exchange of the intermediary transfer member or a unit including the intermediary transfer member. The secondary transfer roller is required to be provided with a strong urging force toward the intermediary transfer member or the secondary transfer opposite roller in order to obtain a good image quality and suppress slip of the recording material during feeding for secondary transfer.

Further, for engaging (fixing) or holding the secondary transfer unit with an apparatus main assembly, there is a constitution in which one or more engaging portions are provided at a position outside the recording material at each of end portions of the secondary transfer unit. However, the urging force of the secondary transfer roller is strong, and therefore all the engaging portions are not engaged due to reaction force thereof in some cases.

In a constitution in which an openable door unit (unit such as a double-side-feeding unit) is provided outside the secondary transfer unit, the engaging portions of the secondary transfer unit (inside unit) are in a deep position of the apparatus main assembly and thus is not readily recognized visually, so that there is a liability that improper engagement is not readily recognized. In order to obviate this problem, there is a constitution in which all the engaging portions are provided with a detecting sensor to detect the improper engagement and then a user is caused to engage the secondary transfer unit again with the apparatus main assembly. Further, as described in Japanese Laid-Open Patent Application (JP-A) 2010-286658, there is a constitution in which a rotatable member of an engaging portion is locked using another guiding member in interrelation with an openable member.

However, in the conventional examples described above, the following problem occurred.

The constitution in which all the engaging portions are provided with the detecting sensor to detect the improper engagement and then the user is caused to engage the secondary transfer unit again with the apparatus main assembly is costly. Further, the user is forced to perform a superfluous opening and closing operation, and therefore the constitution is not preferred also in terms of usability.

Further, in the constitution in which the rotatable member of the engaging portion is engaged using another guiding member in interrelation with the openable member, there is a need to ensure a space in an operation region of the guiding member, and thus it is difficult to save the space. Further, the provision of the guiding member is costly.

SUMMARY OF THE INVENTION

A principal object of the present invention is to provide an image forming apparatus capable of reliably engaging an inside unit in a closed state with an apparatus main assembly while realizing cost reduction and space saving in a constitution including an outside unit and the inside unit each being openable relative to the apparatus main assembly.

According to an aspect of the present invention, there is provided an image forming apparatus comprising: a main assembly; a first unit openable relative to the main assembly; a second unit which is provided inner than the first unit and which is openable relative to the main assembly; two engaging portions, provided on the second unit, for placing the second unit in a closed state in engagement with the main assembly; and an urging portion, provided in the first unit, for urging the second unit, wherein the second unit is urged by the urging portion of the first unit so that a state of the second unit is capable of being changed from an open state to the closed state, and wherein the urging portion urges a region in a neighborhood of a central portion of the second unit with respect to a direction of arrangement of the two engaging portions.

These and other objects, features and advantages of the present invention will become more apparent upon a consideration of the following description of the preferred embodiments of the present invention taken in conjunction with the accompanying drawings.

DESCRIPTION OF THE EMBODIMENTS

Hereinbelow, embodiments of the present invention will be specifically described with reference to the drawings. However, dimensions, materials and shapes of constituent elements and their relative arrangements and the like described in the following embodiments should be changed appropriately depending on structures and various conditions of apparatuses (devices) to which the present invention is applied, and the scope of the present invention is not intended to be limited to the following embodiments.

Embodiment 1

Embodiment 1 will be described.

Figure 15:
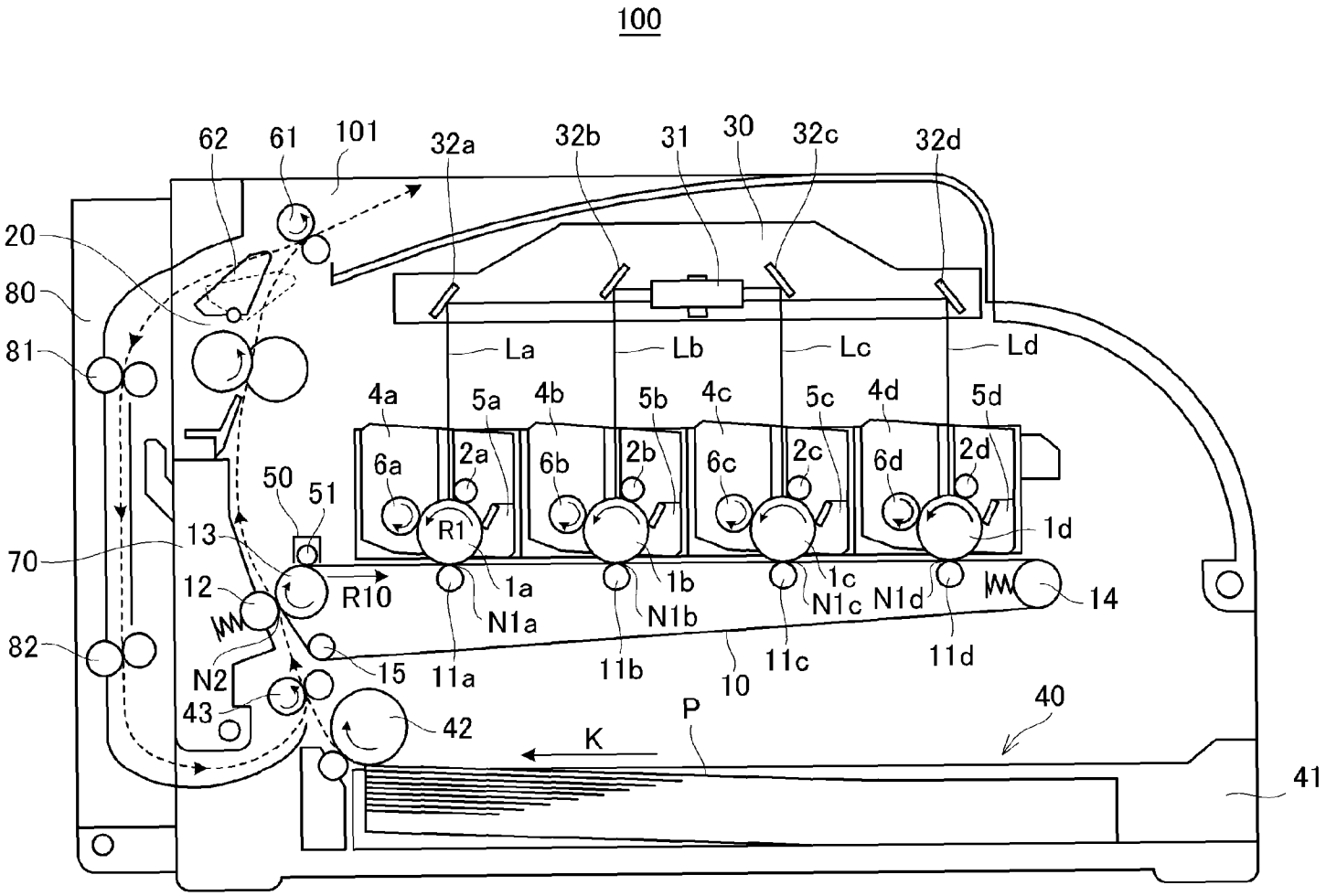
FIG. 15 is a sectional view showing a schematic structure of an image forming apparatus of Embodiment 1.

FIG. 15 is a sectional view showing an image forming apparatus 100 in this embodiment.

The image forming apparatus 100 is a tandem-type four-color based color laser beam printer of an electrophotographic type and uses an intermediary transfer member. A schematic structure of the image forming apparatus 100 will be described. Constitutions and operations of four image forming portions are substantially the same except that colors of developers (toners) used are different from each other. Therefore, in the following description, in the case where there is no need to particularly distinguish the image forming portions, suffixes a, b, c and d of reference numerals or symbols given for representing elements provided for associated colors (yellow, magenta, cyan and black in this embodiment) are omitted and the elements will be collectively described.

The image forming apparatus 100 includes a drum-shaped electrophotographic photosensitive member (photosensitive drum) 1 as a first image bearing member for each of the colors. The photosensitive drum 1 is supported by an apparatus main assembly (image forming apparatus main assembly or main assembly unit) 101 of the image forming apparatus 100, and is rotationally driven by a driving means (not shown) in an arrow R1 direction in FIG. 15.

At a periphery of the photosensitive drum 1, along a rotational direction, a charging roller 2 of a contact type, an exposure device 30, a developing device 4, a developing roller 6 (6*a*, 6*b*, 6*c*, 6*d*), an intermediary transfer belt (intermediary transfer member) 10 as a second image bearing member, and a portion cleaning device 5 are provided substantially in the listed order.

The charging roller 2 electrically charges the surface of the photosensitive drum 1 uniformly. The surface of the photosensitive drum 1 is irradiated with laser light L emitted from the exposure device 30 depending on image information to form a latent image (electrostatic latent image) thereon. The developing device 4 develops the electrostatic latent image into a toner image (developer image) by depositing the toner on the electrostatic latent image. The photosensitive drum cleaning device 5 removes a primary transfer residual toner remaining on the surface of the photosensitive drum 1. The toner image is primary-transferred from the photosensitive drum 1 onto the intermediary transfer belt 10.

On an inner peripheral surface of the intermediary transfer belt 10, a primary transfer roller 11 is provided. The intermediary transfer belt 10 is pressed (urged) against the surface of the photosensitive drum 1 by the primary transfer roller 11, so that a primary transfer nip N1 is formed between the photosensitive drum 1 and the intermediary transfer belt 10. To the primary transfer roller 11, a primary transfer bias (voltage) is applied by a power (voltage) source (not shown). Further, at a position, opposing a driving roller 13, on an outer peripheral surface of the intermediary transfer belt 10, a secondary transfer roller 12 as a secondary transfer member is provided, so that a secondary transfer nip N2 is formed between the secondary transfer roller 12 and the intermediary transfer belt 10. To the secondary transfer roller 12, a secondary transfer bias is applied by a power source (not shown). Further, as described later, a cleaning roller (roller charger) 51 of an electrostatic intermediary transfer belt cleaning device 50 is provided. The cleaning roller 51 is disposed downstream of the secondary transfer nip N2 and upstream of the primary transfer nip N1 with respect to a movement (rotation) direction of the intermediary transfer belt 10 so as to oppose the outer peripheral surface of the intermediary transfer belt 10.

A recording material feeding device 40 feeds a recording material P to the image forming portion, and is constituted by including a recording material cassette 41 accommodating a plurality of sheets of the recording material P, a feeding roller 42, a registration roller 43 and the like. Further, in a downstream side of the secondary transfer nip N2 with respect to a feeding direction (arrow K direction in FIG. 15) of the recording material, a fixing device 20 for fixing the toner image, transferred on the recording material P, under application of heat and pressure is provided.

The image forming apparatus 100 in this embodiment will be described specifically. The photosensitive drum 1 is constituted by forming a photoconductive layer of an OPC (organic photoconductor) or the like on an outer peripheral surface of an aluminum cylinder. The charging roller 2 is constituted by a core metal and an electroconductive elastic member surrounding the core metal, and is rotated by rotation of the photosensitive drum 1 in contact with the surface of the photosensitive drum 1. A charging bias is applied to the charging roller 2 by a power source (not shown). The exposure device 30 includes a laser oscillator (not shown) emitting the laser light L depending on the image information, a polygon mirror 31, a mirror 32 and the like, and exposes the surface of the charged photosensitive drum 1 to the laser light L depending on the image information, so that the electrostatic latent image is formed on the surface of the photosensitive drum 1. The developing device 4 is disposed in a developing position opposing the surface of the photosensitive drum 1 so as to be subjected to development of the electrostatic latent image on the photosensitive drum 1. The electrostatic latent image formed on the surface of the photosensitive drum 1 is developed, so that the toner image is formed. This operation is performed for every color.

The intermediary transfer belt 10 is formed in an endless shape, and is extended around three supporting rollers consisting of the driving roller 13, a tension roller 14 and an assisting roller 15. The tension roller 14 is rotated by rotation of the intermediary transfer belt 10, and stretches the intermediary transfer belt 10. The intermediary transfer belt 10 is driven (moved) in an arrow R10 direction shown in FIG. 15 by rotating the driving roller 13 by a driving means (not shown).

An operation of the image forming apparatus 100 in this embodiment will be described.

The photosensitive drum 1*a* rotationally driven in the arrow R1 direction is uniformly charged at its surface by applying the charging bias in the form of a DC voltage biased with an AC voltage to the charging roller 2. When a yellow image signal is inputted into the laser oscillator (not shown), the laser light La is emitted, so that the surface of the charged photosensitive drum 1*a* is irradiated with the laser light La, so that the electrostatic latent image is formed on the surface of the photosensitive drum 1*a*. When the photosensitive drum 1*a* is further rotated in the arrow R1 direction, the electrostatic latent image on the photosensitive drum 1*a* is developed into the toner image by deposition of a yellow toner by the yellow developing device 4*a*. The yellow toner image on the photosensitive drum 1*a* is primary-transferred onto the intermediary transfer belt 10 via the primary transfer nip N1*a* by the primary transfer bias applied to the primary transfer roller 11*a*. The primary transfer residual toner remaining on the surface of the photosensitive drum 1*a* after the transfer of the yellow toner image is removed by the photosensitive drum cleaning device 5*a*, so that the photosensitive drum 1*a* is subjected image formation.

A series of the image forming process steps of charging, exposure, development, primary transfer and cleaning is repetitively performed for other three colors, i.e., magenta, cyan and black in consideration of intervals of the primary transfer nips N1*a* to N1*d*, and then the respective color images are superposed on the intermediary transfer belt 10. As a result, four color toner images are formed on the intermediary transfer belt 10.

The four color toner images are secondary-transferred from the intermediary transfer belt 10 onto the recording material P fed to the secondary transfer nip N2 in the arrow K direction by the secondary transfer bias applied to the secondary transfer roller 12 by the power source.

After the toner image transfer through the secondary transfer nip N2, the recording material P is fed to the fixing device 20, wherein the toner images are melt-fixed under application of heat and pressure, so that a four-color based full-color image is obtained. Thereafter, the recording material P is discharged to an outside of the image forming apparatus by a discharging roller 61.

During double-side printing (image formation), after the neighborhood of a trailing end of the recording material P reaches the discharging roller 61, a flapper 62 moves to a double-side-feeding position by an unshown driving means. Then, the discharging roller 61 is reversely rotated by an unshown driving means so that the recording material P is sent to a double-side-feeding unit (feeding unit for double-side printing) 80. In the double-side-feeding unit 80, the recording material P is fed to the registration roller 43 by rollers 81 and 82 for double-side printing. The double-side-feeding unit 80 corresponds to an unit (first unit), and in which a part of a feeding path for feeding the recording material P when the image is formed on both (double) surfaces of the recording material P is formed.

Thereafter, printing of the image on a second surface of the recording material P is performed similarly as in the case of the first surface of the recording material P. The recording material P subjected to the double-side printing is discharged to the outside of the image forming apparatus by the discharging roller 61.

On the intermediary transfer belt 10 after the toner image transfer, a secondary transfer residual toner which has not been transferred onto the recording material P remains. The residual toner on the intermediary transfer belt 10 is collected in the photosensitive drum cleaning device 5 via the photosensitive drum 1 by the intermediary transfer belt cleaning device 50. That is, electric charges of an opposite polarity (positive in this embodiment) to a normal charge polarity of the toner is imparted to the residual toner by the intermediary transfer belt cleaning means, so that the residual toner is moved (reversely transferred) onto the photosensitive drum 1.

The moved secondary transfer residual toner is removed together with the primary transfer residual toner remaining on the photosensitive drum 1 by the photosensitive drum cleaning device 5.

Next, a constitution peculiar to this embodiment will be described with reference to FIGS. 1 to 19.

Figure 1:
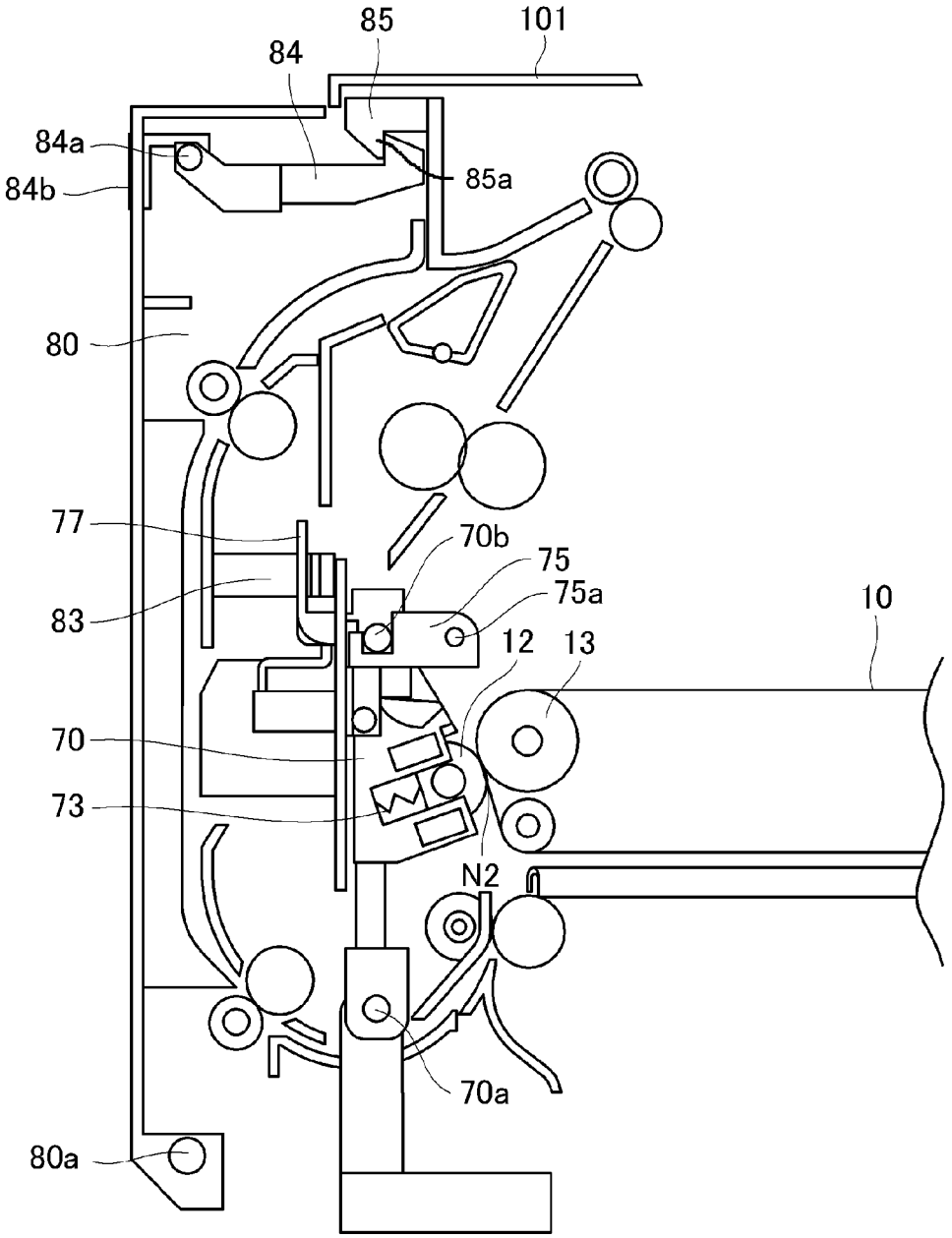
FIG. 1 is a sectional view showing a schematic structure of a principal part of a double-side-feeding unit in closed state in Embodiment 1.

FIG. 1 is a sectional view showing a schematic structure of a principal part of the double-side-feeding unit 80 in a closed state (locked state) in the image forming apparatus in this embodiment.

The double-side-feeding unit 80 is constituted so as to be openable relative to the apparatus main assembly 101. At an inner portion relative to the double-side-feeding unit 80 in the image forming apparatus 100, a secondary transfer unit 70 as an inside unit (second unit) is provided. Also the secondary transfer unit 70 is constituted so as to be openable relative to the apparatus main assembly 101. The secondary transfer unit 70 supports the secondary transfer roller 12, for secondary-transferring onto the recording material P the toner image primary-transferred on the intermediary transfer belt 10, via a secondary transfer spring (urging member) 73.

As shown in FIG. 1, in a state in which the double-side-feeding unit 80 is closed, also the secondary transfer unit 70 is in a closed state. Further, in this embodiment, a constitution in which the secondary transfer unit 70 is capable of performing an opening and closing operation in interrelation with an opening and closing operation of the double-side-feeding unit 80 is employed.

The secondary transfer unit 70 is constituted so as to be openable by being rotated about pivots 70*a* and in the closed state, is held by the pivots 70*a* and engaging bosses 70*b* provided therein. The engaging bosses 70*b* are engaged and locked by a secondary transfer unit lock (apparatus main assembly-side engaging portion) 75 mounted in the apparatus main assembly 101, so that the secondary transfer unit 70 is placed in the closed state. The engaging boss 70*b* corresponds to the engaging portion.

The secondary transfer unit lock 75 is constituted so as to be rotatable about a secondary transfer unit pivot 75*a* in a region below a locking position shown in FIG. 1, and is urged by an unshown spring so as to rotate clockwisely in FIG. 1.

The secondary transfer roller 12 is urged toward the driving roller (secondary transfer opposite roller) 13 via the intermediary transfer belt 10 by a secondary transfer spring 73, so that the secondary transfer nip N2 is formed between the secondary transfer roller 12 and the intermediary transfer belt 10. Reaction force generated in the secondary transfer roller 12 by the formation of the secondary transfer nip N2 is constituted so as to be received via the secondary transfer unit 70, by the pivots 70*a* and the secondary transfer unit lock 75 urged so as to rotate clockwisely.

Further, in this embodiment, the reaction force exerted on the secondary transfer unit 70 when the secondary transfer spring 73 urges the secondary transfer roller 12 is large, and therefore the engaging bosses 70*b* and the secondary transfer unit lock 75 are disposed as follows. That is, with respect to a widthwise direction (which is a rotational axis direction of the photosensitive drum 1 and which corresponds to a predetermined direction) of the recording material P perpendicular to a feeding direction of the recording material P, each of the engaging bosses 70*b* and the secondary transfer unit lock 75 are provided outside the recording material P (i.e., in an end portion side or in a non-passing region through which the recording material P does not pass). As a result, a retaining force exerted on each of the portions can be reduced to ½ thereof.

The double-side-feeding unit 80 is constituted so as to be openable by being rotated about pivots 80*a* for double-side printing, and in the closed state, is held by the pivots 80*a* and a lock 84 for double-side printing provided in the double-side-feeding unit 80. The lock 84 is locked by lock-receiving portions 85*a* mounted in the apparatus main assembly 101. The lock 84 is constituted so as to be rotatable about lock-supporting portions 84*a* by a user in a region below the locking position, and is urged so as to be rotated counterclockwisely in FIG. 1 by an unshown spring.

In this embodiment, the double-side-feeding unit 80 is provided with hooking claws 83 as hooking members. The hooking claws are provided at claw free end portions with tapered claw portions 83*a* and 83*b* and hooking portions 83*c* and 83*d* as described later. The tapered claw portions 83*a* and 83*b* are disposed closer to the free end sides than the hooking portions 83*c* and 83*d* with respect to a movement direction of the double-side-feeding unit 80 during the closing operation.

Figure 2:
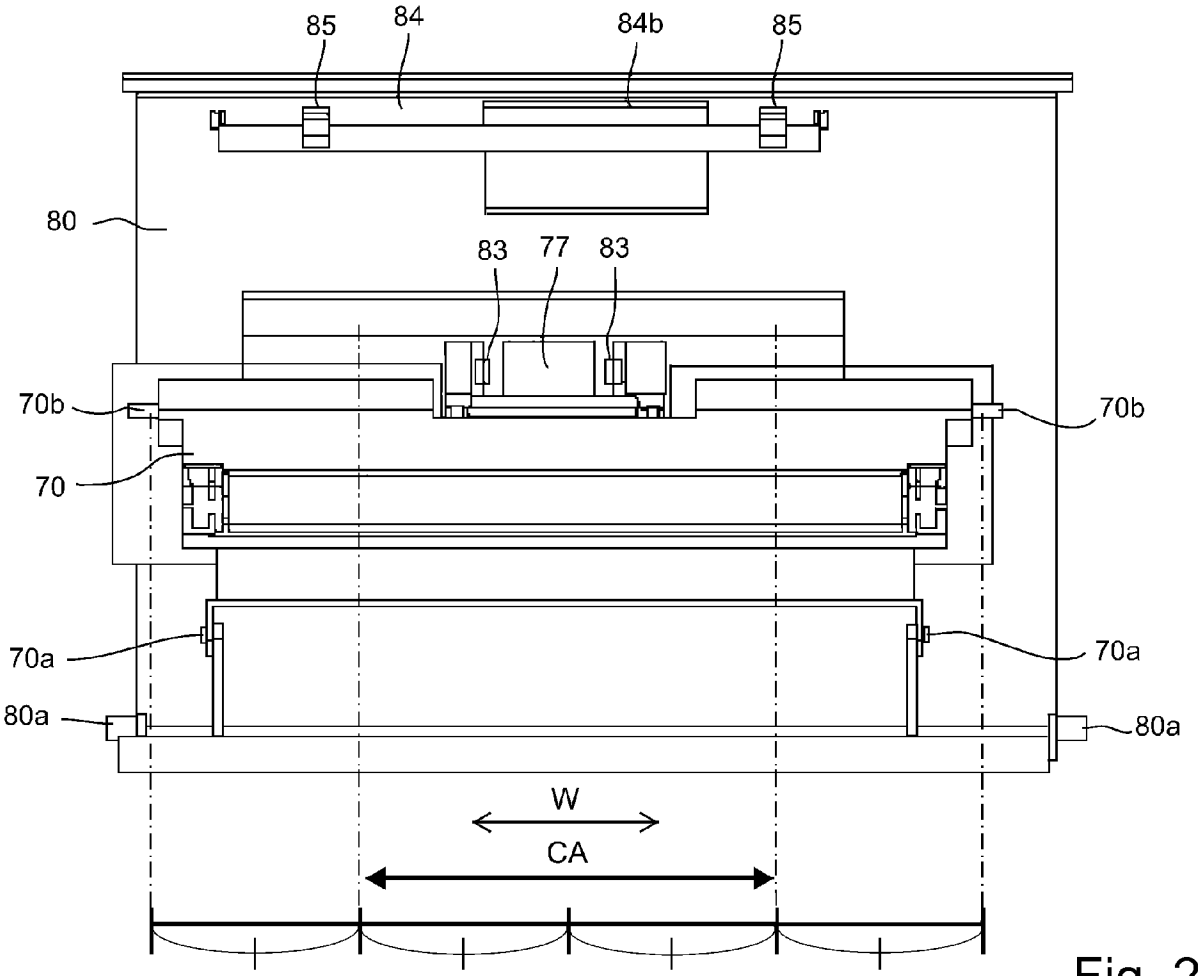
FIG. 2 is a schematic view of the double-side-feeding unit and a secondary transfer unit as seen from an apparatus main assembly side.
Figure 3:
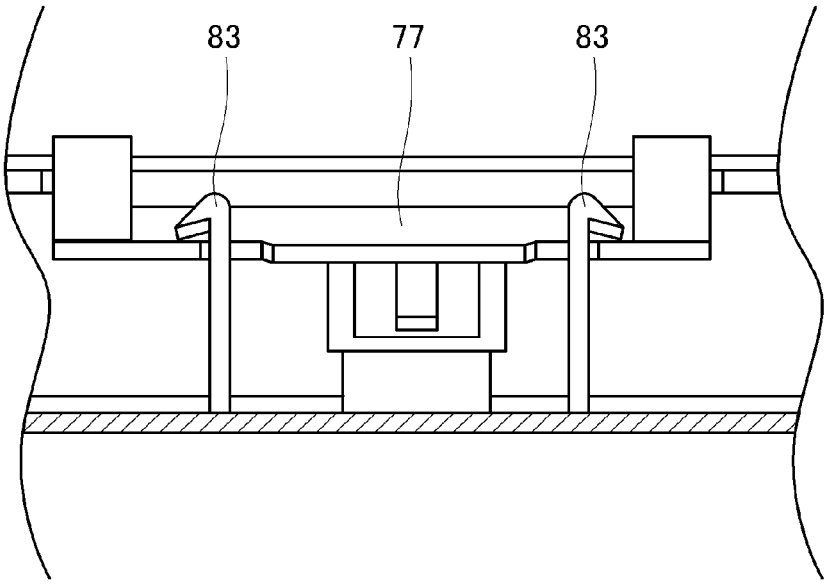
FIG. 3 is a schematic view of a portion in the neighborhood of a hooking claw in the closed state of the double-side-feeding unit as seen from above.

FIG. 2 is a schematic view of the double-side-feeding unit 80 and the secondary transfer unit 70 each in the closed state as seen from the apparatus main assembly 101 side. FIG. 3 is a schematic view of a portion in the neighborhood of the hooking claws 83 in the closed state of the double-side-feeding unit 80 as seen from above. The hooking claws 83 are, as shown in FIG. 3, when the double-side-feeding unit 80 in the closed state is seen from above, disposed so as to penetrate through a lever 77 (FIGS. 1 and 2) provided in the neighborhood of an upper central portion of the secondary transfer unit 70.

The lever 77 is provided rotatably (movably) relative to a unit main assembly, and corresponds to a predetermined portion which is a part between two engaging bosses 70*b* provided at end portions of the secondary transfer unit 70. Further, the lock 84 for double-side printing is provided at each of the end portions in the neighborhood of outside portions of the recording material P with respect to a widthwise direction of the recording material P perpendicular to a feeding direction of the recording material P in consideration of suppression of jerking, creep and the like when the double-side-feeding unit 80 is closed.

Figure 4:
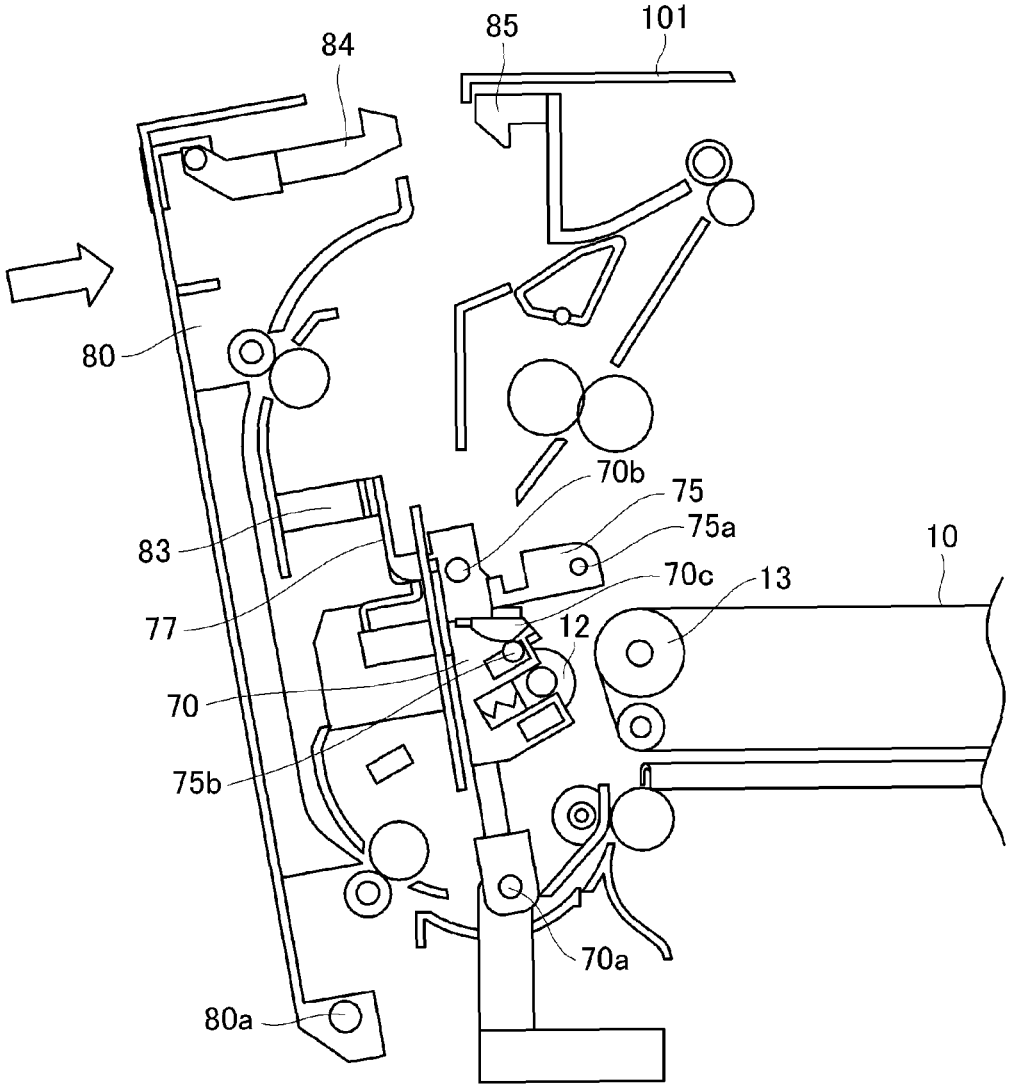
FIG. 4 is a schematic view for illustrating an operation of each of the units when the double-side-feeding unit is closed.
Figure 5:
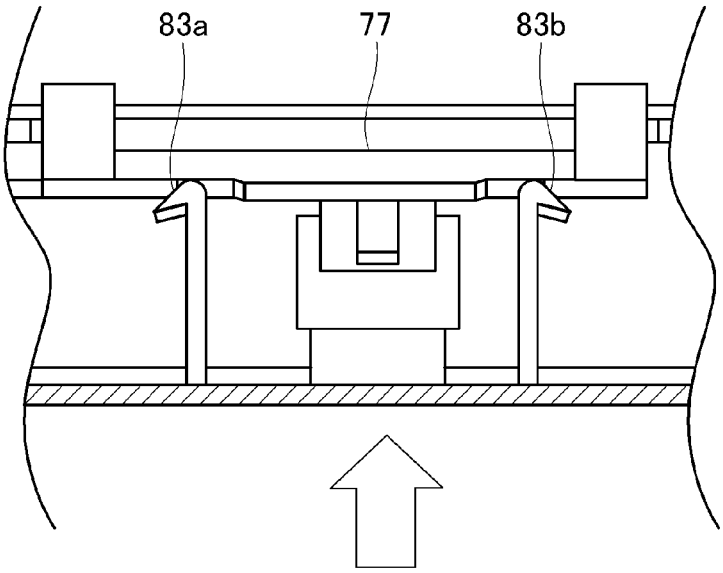
FIG. 5 is a schematic view of the portion in the neighborhood of the hooking claw in a state shown in FIG. 4 as seen from above.
Figure 6:
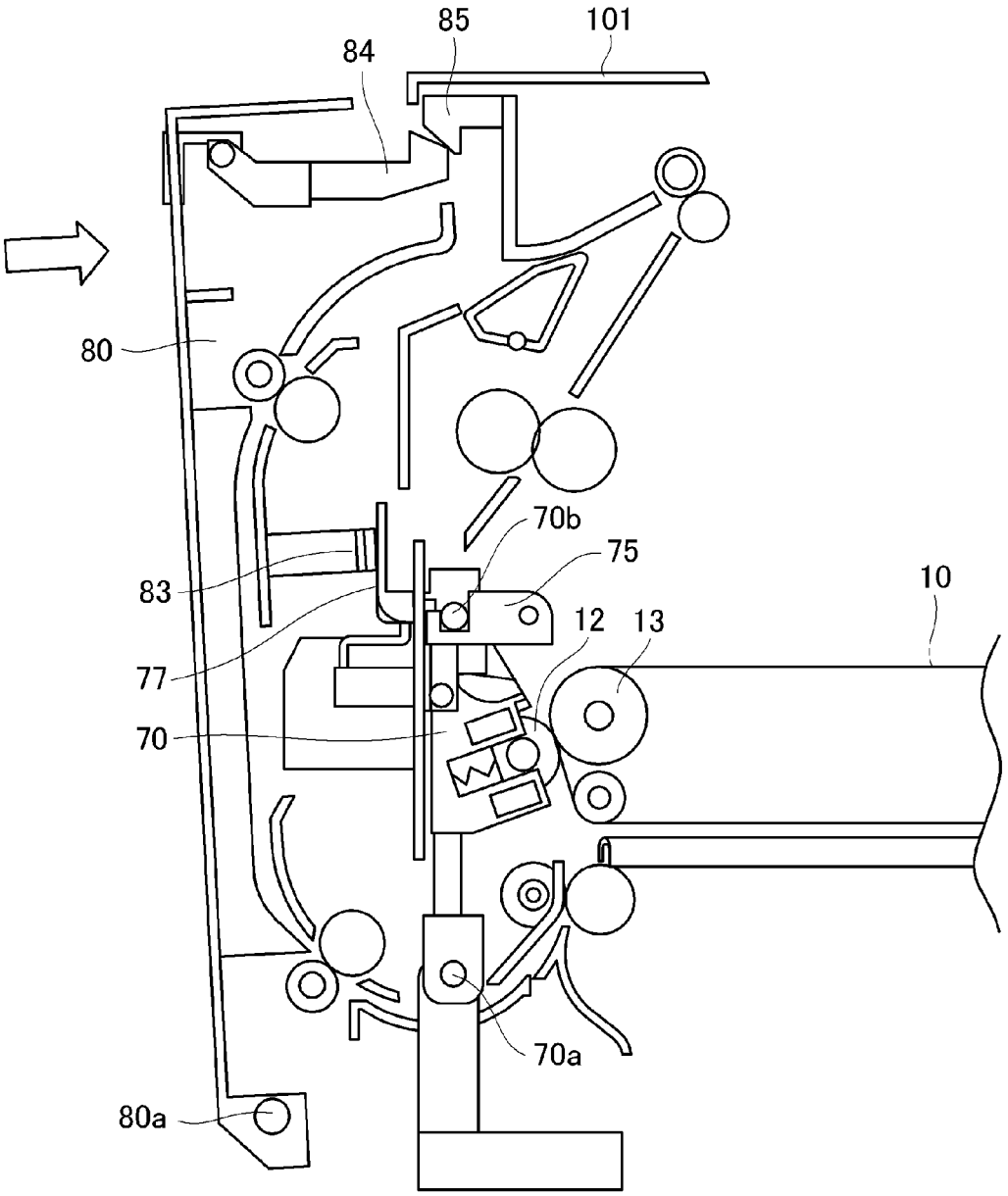
FIG. 6 is a schematic view showing a state in which the double-side-feeding unit is further closed from the state shown in FIG. 4.
Figure 7:
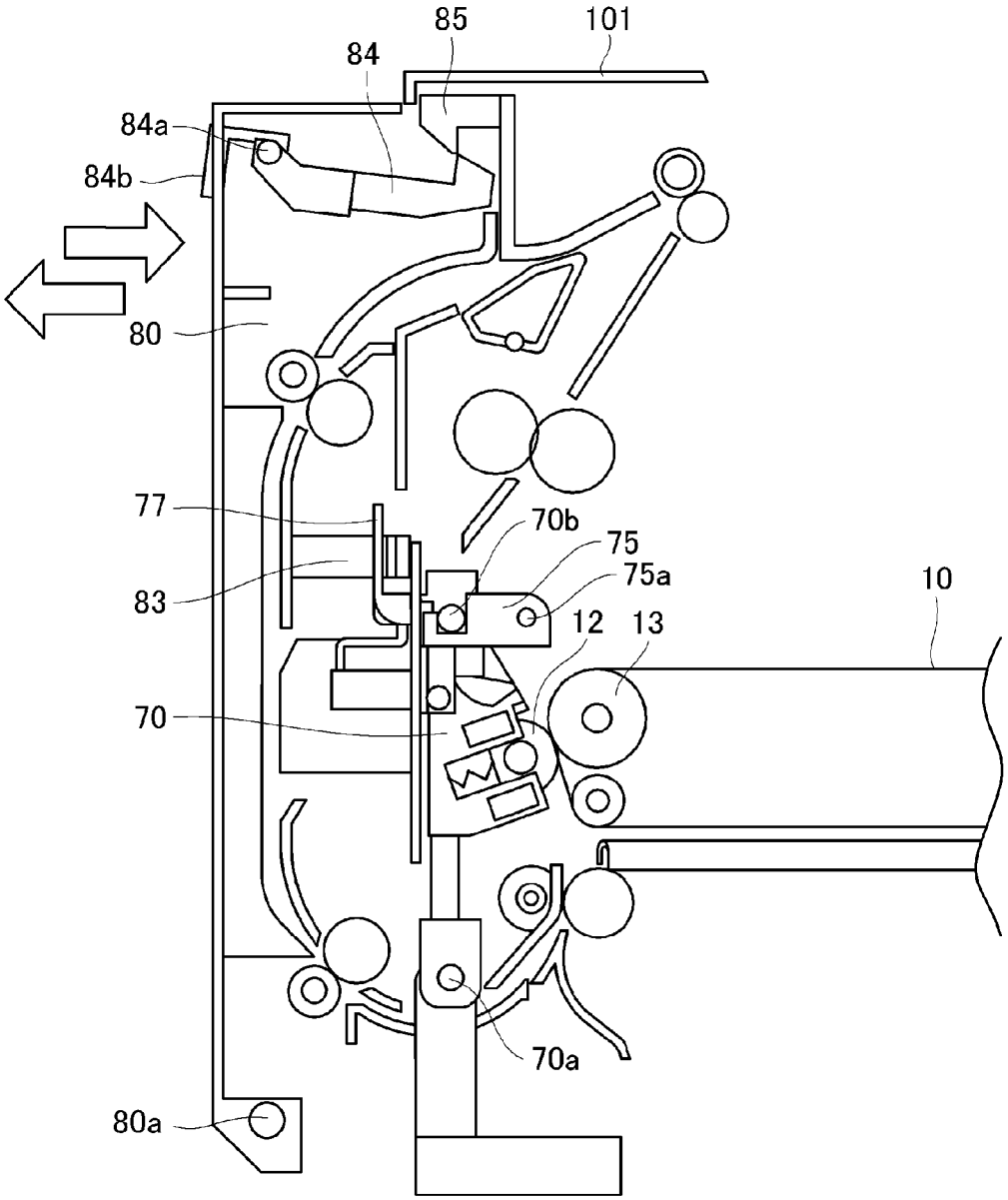
FIG. 7 is a schematic view showing a state in which the double-side-feeding unit is further closed from a state shown in FIG. 6.

Next, a closing operation of the double-side-feeding unit 80 and the secondary transfer unit 70 when the double-side-feeding unit 80 is closed in an open state of the double-side-feeding unit 80 and the secondary transfer unit 70 will be described with reference to FIGS. 4-7. FIG. 4 is a schematic view for illustrating an operation of the double-side-feeding unit 80 and the secondary transfer unit 70 when the double-side-feeding unit 80 is closed. FIG. 5 is a schematic view of a portion in the neighborhood of the hooking claws 83 as seen from above in a state in a state shown in FIG. 4. FIG. 6 is a schematic view showing a state in which the double-side-feeding unit 80 is further closed from the state shown in FIG. 4. FIG. 7 is a schematic view showing a state in which the double-side-feeding unit 80 is further closed from a state shown in FIG. 6.

When the double-side-feeding unit 80 is closed from the open state, an unshown cam-receiving surface of the secondary transfer unit 70 is urged against an unshown cam surface of the double-side-feeding unit 80 when a user pushes and closes the double-side-feeding unit 80. As a result, the secondary transfer unit 70 is closed in interrelation with the double-side-feeding unit 80. In view of an operation property such as jam clearance, a constitution in which in a state in which the double-side-feeding unit 80 is opened, only the secondary transfer unit 70 can be opened and closed is employed.

When the double-side-feeding unit 80 reaches a predetermined angle shown in FIG. 4, tapered claw portions 83*a* and 83*b* of the hooking claw 83 provided in the double-side-feeding unit 80 contact the lever 77 of the secondary transfer unit 70 (FIG. 5). The secondary transfer unit lock 75 is pushed down counterclockwisely against an urging force in FIG. 4 by pushing down a cam boss 75*b* therein by a cam 70*c* in the secondary transfer unit 70.

When the double-side-feeding unit 80 is further closed, the tapered claw portions (urging portions) 83*a* and 83*b* of the hooking claws 83 push (urge) the lever 77, whereby the secondary transfer unit 70 is pulled into a locking position (FIG. 6). As a result, the secondary transfer unit lock 75 presses the engaging bosses 70*b* to prevent rotation of the secondary transfer unit 70, so that the secondary transfer unit 70 is locked by the apparatus main assembly 101 at two positions. At this time, the double-side-feeding unit 80 is not yet closed.

In this embodiment, the two hooking claws 83 are provided along a widthwise direction W (left-right direction in FIG. 5) of the recording material P perpendicular to the feeding direction of the recording material P, and are formed in a symmetrical shape with respect to the widthwise direction W of the recording material P. As a result, with respect to the widthwise direction W of the recording material P, positional deviation between the hooking claws 83 and the lever 77 can be corrected, so that the tapered claw portions

83*a* and 83*b* can push the lever 77 with the substantially same force. The widthwise direction W of the recording material P coincides with a rotation center direction (rotational axis direction) of the rotation pivot 70*a* and the rotation pivot 80*a* for double-side printing and a direction of arrangement of the two engaging bosses 70*b*.

Further, in this embodiment, a constitution in which the hooking claws 83 of the double-side-feeding unit 80 push (urge) a portion in the neighborhood of an upper portion of the secondary transfer unit 70 is employed. As a result, a phenomenon such that the two secondary transfer unit locks 75 are maintained in a one-side-engaged (closed or locked) state (improper locking state) in which one is locked (engaged or closed) and the other is not locked (engaged or closed) can be suppressed. That is, when the user (operator) pushes and closes the double-side-feeding unit 80, the hooking claws 83 urge a portion in the neighborhood of the central portion between the two engaging bosses 70*b* of the secondary transfer unit 70 even when the user pushes the double-side-feeding unit 80 at any position with respect to the widthwise direction W (the direction of arrangement of the two engaging bosses 70*b*). For this reason, the one-side-engaged state is one in which only either one of the two engaging bosses 70*b* engages with the secondary transfer unit lock 75, so that each of the two engaging bosses 70*b* engages with the secondary transfer unit lock 75.

That is, positions of the two hooking claws 83 urging the secondary transfer unit 70 may only be required to be disposed in two sections (region in the neighborhood of the central portion) CA when a region between the two engaging bosses 70*b* is divided into four equal sections with respect to the widthwise direction W shown in FIG. 2. By disposing the portions (hooking claws 83) for urging the secondary transfer unit 70 in the region CA in the neighborhood of the central portion when the secondary transfer unit 70 is closed, the one-side-engaged state described above can be substantially suppressed.

Figure 16:
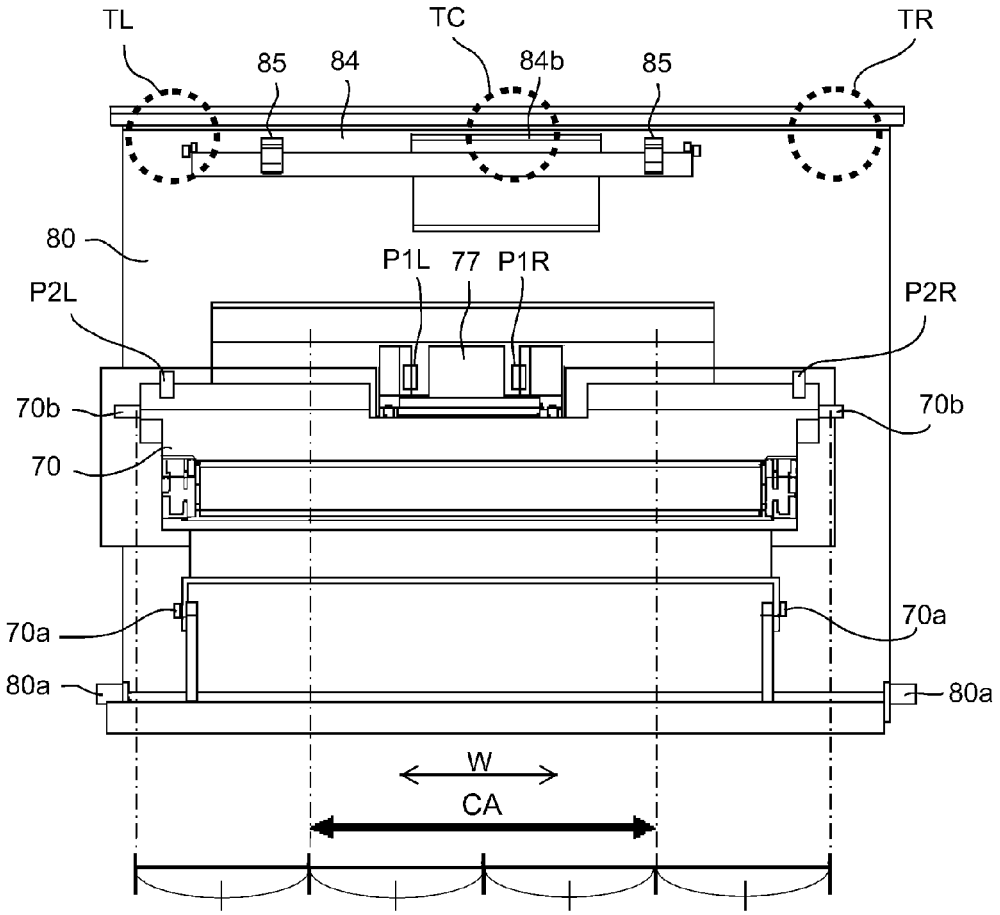
In FIG. 16, (a) is a schematic view showing positions of urging portions and portions-to-be-urged to the double-side-feeding unit and the secondary transfer unit in Forms 1 and 2 as seen from the apparatus main assembly side, and (b) is a table showing a degree of ease of generation of a one-side-engaged (locked or closed) state at the positions of the urging portions and the portion-to-be-urged in Forms 1 and 2.

In FIG. 16, (a) is a schematic view showing positions of urging portions and portion-to-be-urged of the double-side-feeding unit 80 and the secondary transfer unit 70 in Forms 1 and 2 as seen from the apparatus main assembly side. In FIG. 16, (b) is a table showing a degree of ease of generation of the one-side-engaged state at the positions of the urging portions and the portion-to-be-urged in Forms 1 and 2. The portions of the double-side-feeding unit 80 for urging the secondary transfer unit 70 are the urging portions P1L, P1R, P2L and P2R, and the portions of the double-side-feeding unit 80 to be urged by the user to close the double-side-feeding unit 80 are the portion-to-be-urged TL, TC and TR. Further, the number of times (of a test) of the closing operation for closing the double-side-feeding unit 80 by urging the double-side-feeding unit 80 from a state in which the double-side-feeding unit 80 and the secondary transfer unit 70 are open is the number of closing operations ("NOCO"), of which the number of times of the one-side-engaged state is the number of one-side-engaged state ("NOOSES").

In Form 1, the urging portions P1L and P1R were provided at positions in the region OA in the neighborhood of the central portion, which are the same positions as the urging portions 83 in this embodiment. In this case, no one-side-engaged state was generated in 20 times of the closing operation at any of the portions-to-be-urged TL, TC and TR. On the other hand, in Form 2, the urging portions P2L and P2R disposed outside the region CA in the neighborhood of the central portion were provided. In this case, at the portions-to-be-urged TL and TR, the one-side-engaged state was generated 20 times and 15 times, respectively. At the portion-to-be-urged TL, the one-side-engaged state in which the right-side engaging bosses 70*b* in (a) of FIG. 16 are not engaged was generated, and at the portion-to-be-urged TR, the one-side-engaged state in which the left-side engaging bosses 70*b* in (a) of FIG. 16 are not urged was generated. The case where the one-side-engaged state is liable to be generated is the case where a difference between urging forces toward the secondary transfer unit locks 75 corresponding to the left and right engaging bosses 70*b* of the secondary transfer unit 70 is large. In the constitution of Form 2, in the case where the portions-to-be-urged are TL and TR, either one of the urging portions P2L and P2R has a stronger force for urging the secondary transfer unit 70, so that the force is not uniformly transmitted to the secondary transfer unit 70 at the left and right portions. For this reason, the difference between the urging forces toward the secondary transfer unit locks 75 corresponding to the engaging bosses 70*b* becomes large, so that the one-side-engaged state is liable to be generated. On the other hand, in the constitution of Form 1, the urging portions P1L and P1R are positioned in the region CA in the neighborhood of the central portion, and therefore even when the portion-to-be-engaged is positioned at any of TL, TC and TR, the force is relatively uniformly transmitted to the left and right portions of the secondary transfer unit 70 via the urging portions P1L and P1R in the neighborhood of the central portion. For this reason, the difference between the urging forces toward the secondary transfer unit locks 75 corresponding to the left and right engaging bosses 70*b* is small, so that the one-side-engaged state is not readily generate generated.

When the double-side-feeding unit 80 is further closed, the hooking claws 83 deform and ride over the lever 77 at claw feeding portions, so that the hooking portions 83*c* and 83*d* hook on the lever 77 (FIG. 7). Thereafter, the lock 84 for double-side printing enters the lock receiving portion 85 for double-side printing, so that the rotation of the double-side-feeding unit 80 is prevented. As a result, the double-side-feeding unit 80 is locked by the apparatus main assembly 101 at both of the two portions. By employing such a constitution, when the double-side-feeding unit 80 is locked by the apparatus main assembly 101, the double-side-feeding unit 80 does not receive reaction force of the secondary transfer unit 70 and reaction force for urging the lever 77 by the hooking claws 83.

Figure 8:
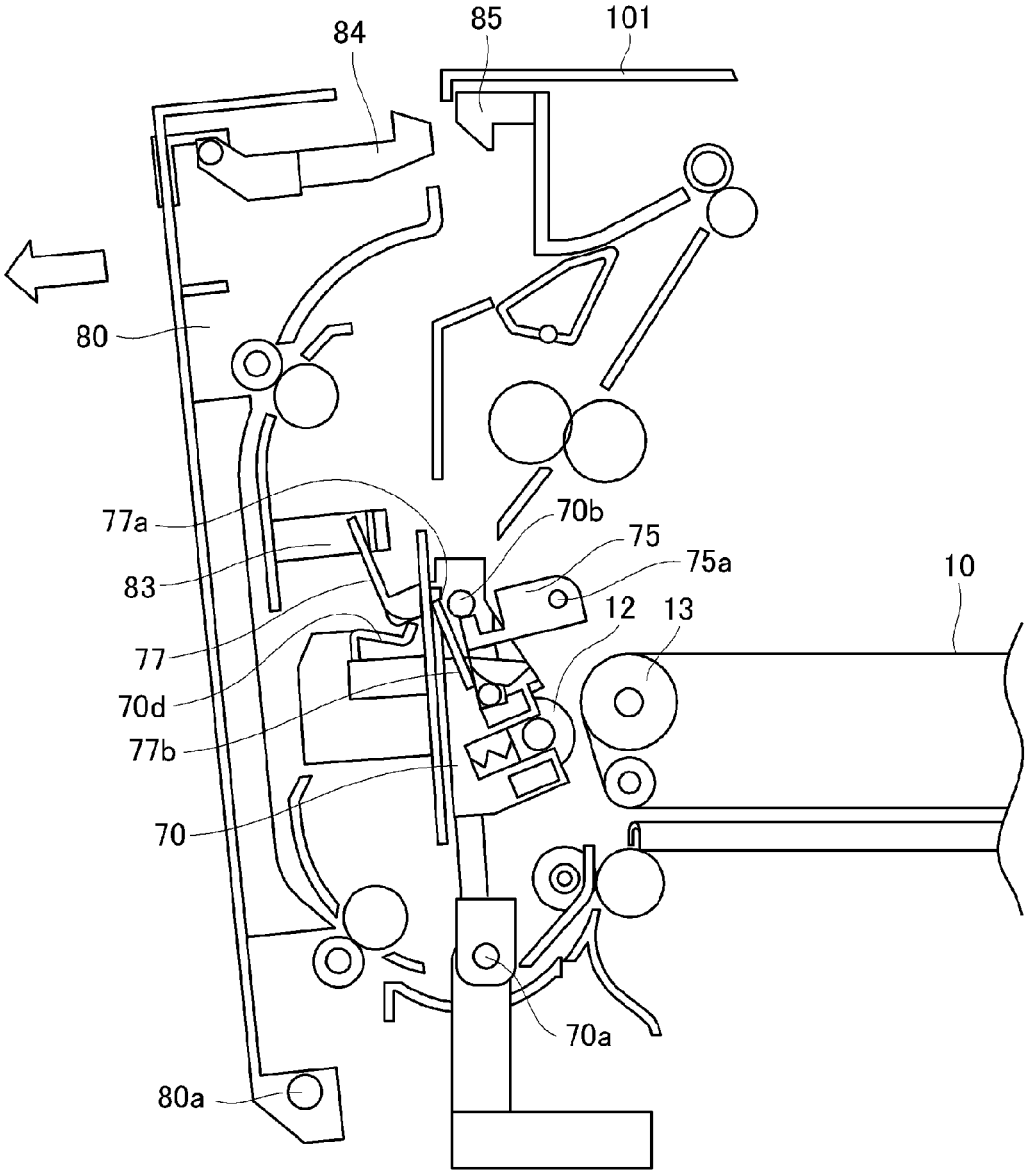
FIG. 8 is a schematic view showing a state in which the double-side-feeding unit is opened from a state shown in FIG. 7.
Figure 9:
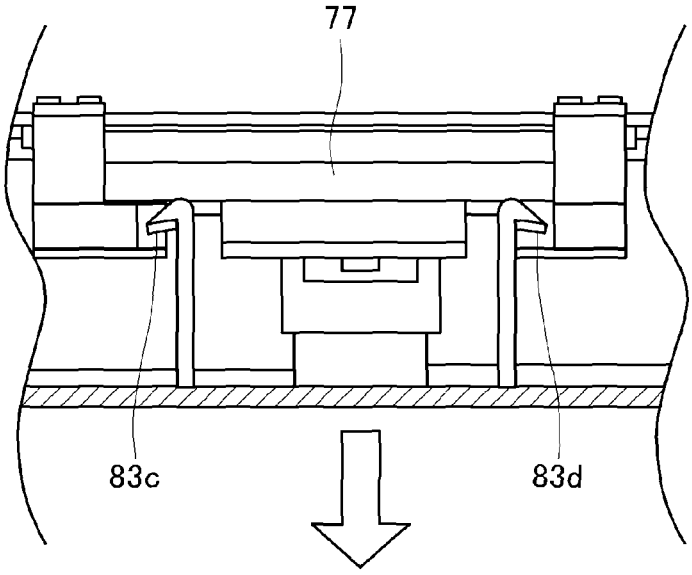
FIG. 9 is a schematic view of the portion in the neighborhood of the hooking claw in a state shown in FIG. 8 as seen from above.

Next, an opening operation of the double-side-feeding unit 80 and the secondary transfer unit 70 when the double-side-feeding unit 80 is opened from the closed state of the double-side-feeding unit 80 and the secondary transfer unit 70 will be described with reference to FIGS. 7 to 9. FIG. 8 is a schematic view showing a state in which the double-side-feeding unit 80 is opened from a state shown in FIG. 7. FIG. 9 is a schematic view of a portion in the neighborhood of the hooking claws 83 as seen from above in a state shown in FIG. 8.

When the double-side-feeding unit 80 is opened, the lock 84 for double-side printing rotates clockwisely about a lock supporting portion 84*a* for double-side printing in an arrow direction indicated in FIG. 7 when the user pulls a lock handle 84*b* for double-side printing, so that the lock 84 spaces from the lock receiving portion 85 and thus lock of the double-side-feeding unit 80 is eliminated (released) (FIG. 7). When the double-side-feeding unit 80 is further opened, the hooking portions 83*c* and 83*d* of the hooking claws 83 pull the lever 77 (FIGS. 8 and 9).

As a result, the lever 77 rotates counterclockwise about a lever rotation pivot 77*a*, so that a lock releasing portion 77*b* for double-side printing as a releasing portion operating in interrelation with the lever 77 by being mounted on the lever 77 pushes the lock 75. The lock 75 rotates counterclockwisely about the lock pivot 75*a* from the locking position in the arrow direction indicated in FIG. 8, so that the engaging bosses 70*b* of the secondary transfer unit 70 are spaced from the lock 75, and thus the lock (engaged state) of the secondary transfer unit 70 is eliminated (FIG. 8).

When the double-side-feeding unit 80 is further opened, the lever 77 rotates further and disconnects from the hooking claws 83. Thereafter, the lever 77 returns to a position of the closed state of the secondary transfer unit 70 by a lever returning spring 70*d* provided in the secondary transfer unit 70.

Thereafter, the secondary transfer unit 70 contacts the double-side-feeding unit 80 by its own weight in a manner such that the cam receiving surface (not shown) thereof contacts the cam surface (not shown) of the double-side-feeding unit 80, so that the secondary transfer unit 70 is opened in interrelation with the double-side-feeding unit 80.

As described above, in this embodiment, the operation when the double-side-feeding unit 80 and the secondary transfer unit 70 are closed is constituted as follows. That is, first, by pushing the lever member (lever 77) provided in the neighborhood of the central portion of the secondary transfer unit 70 with use of the hooking claws 83 of the double-side-feeding unit 80, the secondary transfer unit 70 is locked in the apparatus main assembly 101 at the two portions. Thereafter, the double-side-feeding unit 80 is locked in the apparatus main assembly 101.

As a result, the secondary transfer unit 70 can be engaged in the closed state with the apparatus main assembly 101 with high reliability while realizing cost reduction and space saving (downsizing). Accordingly, improper engagement of the secondary transfer unit 70 and the double-side-feeding unit 80 with the apparatus main assembly 101 can be reduced in degree. Further, it is possible to reduce degrees of image defect and improper feeding which would be considered to be caused due to the improper engagement of the unit openable relative to the apparatus main assembly 101. Further, a surplus opening and closing operation performed by the user can be reduced, so that usability (convenience) can be improved.

The hooking claws 83 may only be required to be constituted so as to urge the region in the neighborhood of the central portion of the secondary transfer unit 70 with respect to the widthwise direction W, and the number thereof is one, two or three or more.

Further, in this embodiment, by using the hooking claws 83 as a constituent member of the double-side-feeding unit 80 pushing the secondary transfer unit 70, it is possible to realize cost reduction and downsizing (space saving). Further, the hooking claws 83 are provided at two positions in one end side and the other end side in a substantially symmetrical manner on the basis of a center between the two double-side-feeding unit locks 75 with respect to the widthwise direction W. That is, the hooking claws 83 are disposed in a symmetrical shape with respect to a plane which includes the center of the two engaging bosses 70*b* with respect to the widthwise direction W and which is perpendicular to the widthwise direction W of the recording material P. As a result, the force exerted on each of the hooking claws 83 can be reduced. The two hooking claws 83 are provided with the tapered claw portions 83*a* inclined with respect to a movement direction of the hooking claws 83. These tapered claw portions 83*a* are provided so as to be symmetrically oriented with respect to the plane which includes the center of the two engaging bosses 70*b* with respect to the widthwise direction W and which is perpendicular to the widthwise direction W of the recording material P. For this reason, positional deviation of the lever 77 from the hooking claws 83 can be corrected, so that the two hooking claws 83 can push the lever 77 with the substantially uniform force.

Further, the lever 77 is constituted so as to be rotatable, and therefore lock release of the secondary transfer unit 70 can be performed by a small operating force. Further, by employing such a constitution, the lever 77 can be more quickly retracted from a rotation locus of the hooking claws 83 when the double-side-feeding unit 80 is closed, and therefore a mechanism portion can be downsized.

There is also a constitution in which lock of the secondary transfer unit 70 is not fixed by a part shape against the reaction force, different from the secondary transfer unit lock 75 in this embodiment, but is suppressed by a force exceeding the reaction force as in a toggle constitution. However, in such a constitution, there is a liability that reliability lowers more than the fixing constitution. In order to improve the reliability of the lock, when the suppressing force is increased, there is a liability that the mechanism portion is upsized to result in an increase in cost or that a high-rigidity material is used to result in an increase in cost. Further, there is also a liability that the operating force when the double-side-feeding unit 80 and the secondary transfer unit 70 are opened increased. In order to obviate these liabilities, it would be also considered that the locking portion is provided at a position remote from the pivot to decrease the suppressing force by moment, but in this case, there is a liability that the apparatus main assembly and the openable unit are upsized.

Further, in this embodiment, the pivot 70*a* of the secondary transfer unit 70 is constituted by a circular shape in cross section, and the rotation prevention of the secondary transfer unit 70 is made by the engaging bosses 70*b* and the secondary transfer unit locks 75, but the present invention is not limited thereto. Also a constitution in which the pivot 70*a* is, e.g., an elongated circular hole in shape and positioning thereof with respect to only a front-rear direction (left-right direction in FIG. 1) in the case where a side where the secondary transfer unit 70 is opened is the front side of the image forming apparatus 100 is made, and positioning thereof in a height direction is made at another position may also be employed. Also positioning of the double-side-feeding unit 80 is similarly performed, and the pivot 80*a* for double-side printing may also be, e.g., the elongated circular hole in shape.

Further, in this embodiment, a constitution in which the hooking claws 83 of the double-side-feeding unit 80 push the lever 77 disposed in the neighborhood of the upper portion of the secondary transfer unit 70 was employed, but the present invention is not limited thereto. The double-side-feeding unit 80 may only be required to be constituted so as to push a portion between the two engaging bosses 70*b* of the secondary transfer unit 70. Further, the number and position of the engaging bosses 70*b* are not particularly limited. The engaging bosses 70*b* may also be provided in plurality or singly. The double-side-feeding unit 80 may only be required to push the secondary transfer unit 70 to cause the secondary transfer unit 70 to perform the closing operation, and after the engaging portion of the secondary transfer unit 70 is engaged with the apparatus main assembly 101, is in the closed state relative to the apparatus main assembly 101.

Further, in this embodiment, as the inside unit, the secondary transfer unit 70 was described, but the present invention is not limited thereto. The present invention is suitably applicable to also a monochromatic image forming apparatus (having a single image forming portion). In such an image forming apparatus, the photosensitive drum is provided at the position of the driving roller 13 (secondary transfer opposite roller) described in this embodiment, and the transfer member is provided at the position of the secondary transfer roller 12 described in this embodiment.

Further, in this embodiment, a constitution in which the double-side-feeding unit 80 and the secondary transfer unit 70 are openable relative to the apparatus main assembly 101 was described, but the present invention is not limited thereto. The present invention can be suitably applied when a constitution in which the unit openable relative to the apparatus main assembly and the inside unit which is disposed inside the image forming apparatus relative to the outside unit and which is openable relative to the apparatus main assembly is employed.

Further, the hooking claws 83 may preferably be positioned between the two double-side-feeding unit lock receiving portions 85 with respect to the widthwise direction W of the recording material P (FIG. 2). Further, the hooking claws 83 may preferably be in a position where the hooking claws 83 overlap with a double-side-feeding unit lock handle 84 with respect to the widthwise direction W of the recording material P or in a position in the neighborhood of the overlapping position.

Further, the number of the hooking claws 83 is not particularly limited, but may also be one, not the plurality. However, in the case where the single hooking claw 83 is used, the force exerted on the single hooking claw 83 increases compared with the case of the plurality of hooking claws 83, and there is a liability that the correction of the positional deviation from the lever 77 cannot be made. Accordingly, the number of the hooking claws 83 may preferably be two.

Further, in this embodiment, the positional deviation of the hooking claws 83 from the lever 77 particularly with respect to the widthwise direction W of the recording material P is corrected by disposing the two hooking claws 83 in the symmetrical manner with respect to the plane perpendicular to the widthwise direction W of the recording material P, but the present invention is not limited thereto. The two hooking claws 83 may only be required to be disposed so as to provide a symmetrical shape with respect to a predetermined phantom plane. As a result, it is possible to correct the positional deviation from the lever 77.

Further, also the direction of the hooking claws 83 is not particularly limited, but may also be a direction turned by 90 degrees from the positions of the hooking claws 83 shown in FIG. 2. At this time, there is a liability that the two hooking claws 83 are not disposed so as to provide the symmetrical shape with respect to the predetermined phantom plane, and thus the positional deviation from the lever 77 cannot be corrected, but it is possible to reduce a degree of improper engagement of the plurality of the engaging portions.

Accordingly, a plurality of hooking claws 83 may preferably be provided so that at least a pair of hooking claws of the plurality of hooking claws 83 is disposed to provide the symmetrical shape with respect to the plane perpendicular to the widthwise direction W of the recording material P, and in a further preferred example, the number of the hooking claws 83 is two.

Embodiment 2

Embodiment 2 will be described.

Figure 10:
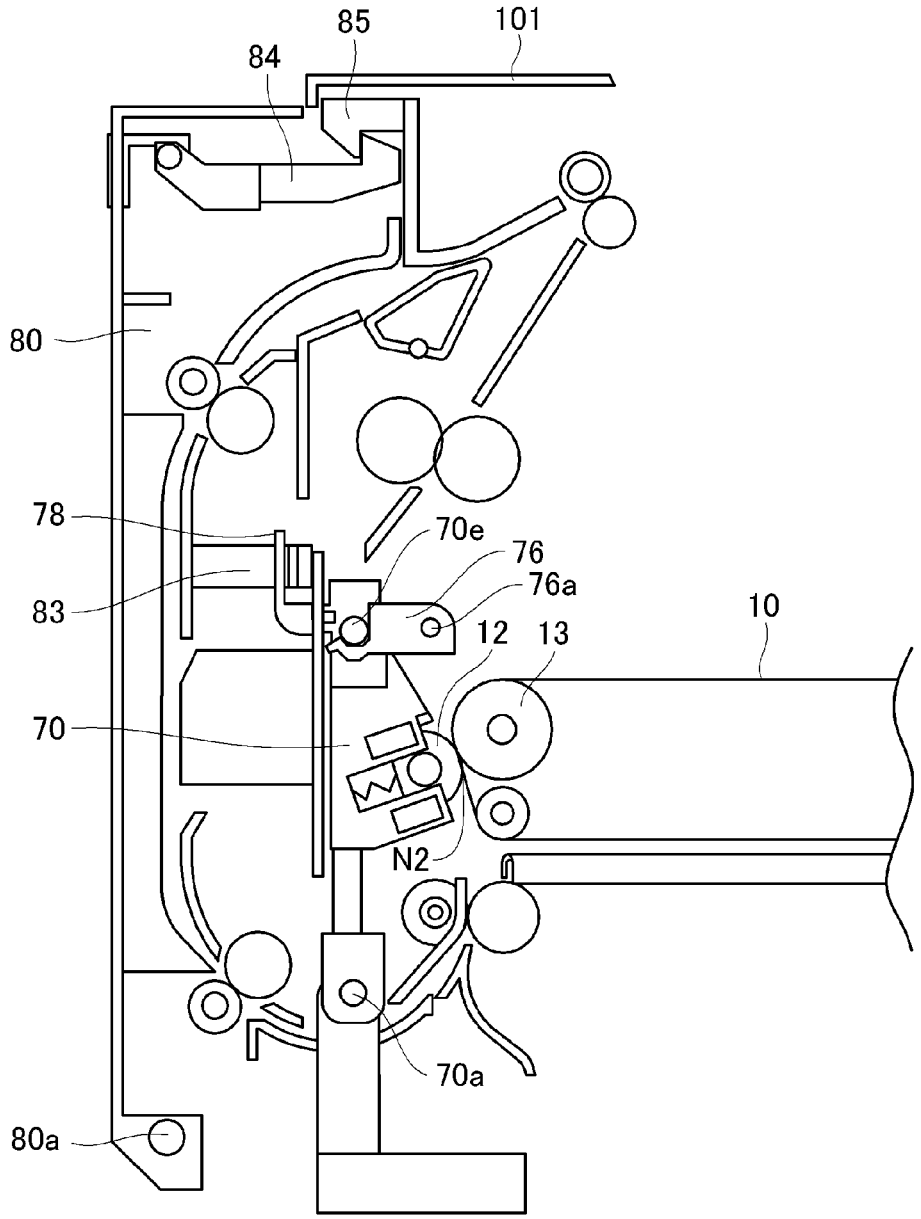
FIG. 10 is a schematic view showing a schematic structure of a principal part of a double-side-feeding unit in a closed state in Embodiment 2.

FIG. 10 is a sectional view showing a schematic structure of a principal part of the double-side-feeding unit 80 in a closed state in the image forming apparatus in this embodiment.

In Embodiment 1, the lever 77 as the lever member provided in the secondary transfer unit 70 was rotatably provided. On the other hand, in this embodiment, a fixing lever 78 as the lever member provided in the secondary transfer unit 70 is fixed on the secondary transfer unit main assembly. In this embodiment, a constitution portion different from Embodiment 1 will be described, and a constitution portion similar to Embodiment 1 will be omitted from description thereof.

In this embodiment, the secondary transfer unit 70 is held in the closed state by the pivot 70*a* and stopping bosses 70*e* in the secondary transfer unit 70. The stopping bosses 70*e* are locked by a secondary transfer unit stopper 76 mounted in the apparatus main assembly 101. The secondary transfer unit stopper 76 is constituted so as to be rotatable about a secondary transfer unit stopper pivot 76*a* in a region below a locking position shown in FIG. 10, and is urged by an unshown spring so as to rotate clockwisely in FIG. 10.

In this embodiment, reaction force of the secondary transfer roller 12 forming the secondary transfer nip N2 is constituted so as to be received via the secondary transfer unit 70, by the pivots 70*a* and the secondary transfer unit stopper 76. Further, the reaction force of the secondary transfer unit 70 is large, and therefore also in this embodiment, with respect to the widthwise direction W of the recording material P perpendicular to the feeding direction of the recording material P, each of the secondary transfer unit stoppers 76 is provided outside the recording material P. As a result, a retaining force exerted on each of the portions can be reduced to ½ thereof.

Figure 11:
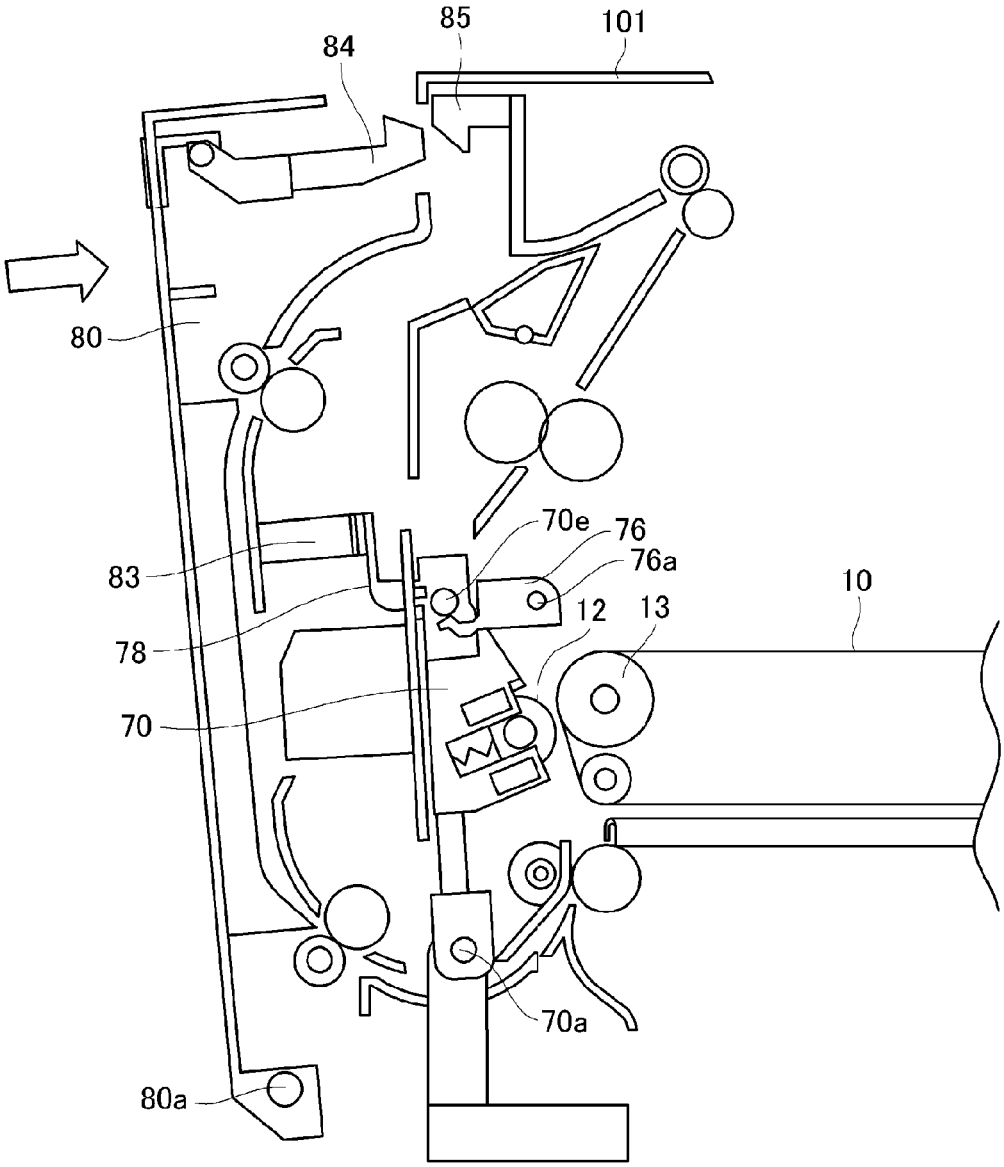
FIG. 11 is a schematic view for illustrating an operation of each of units when the double-side-feeding unit is closed.
Figure 12:
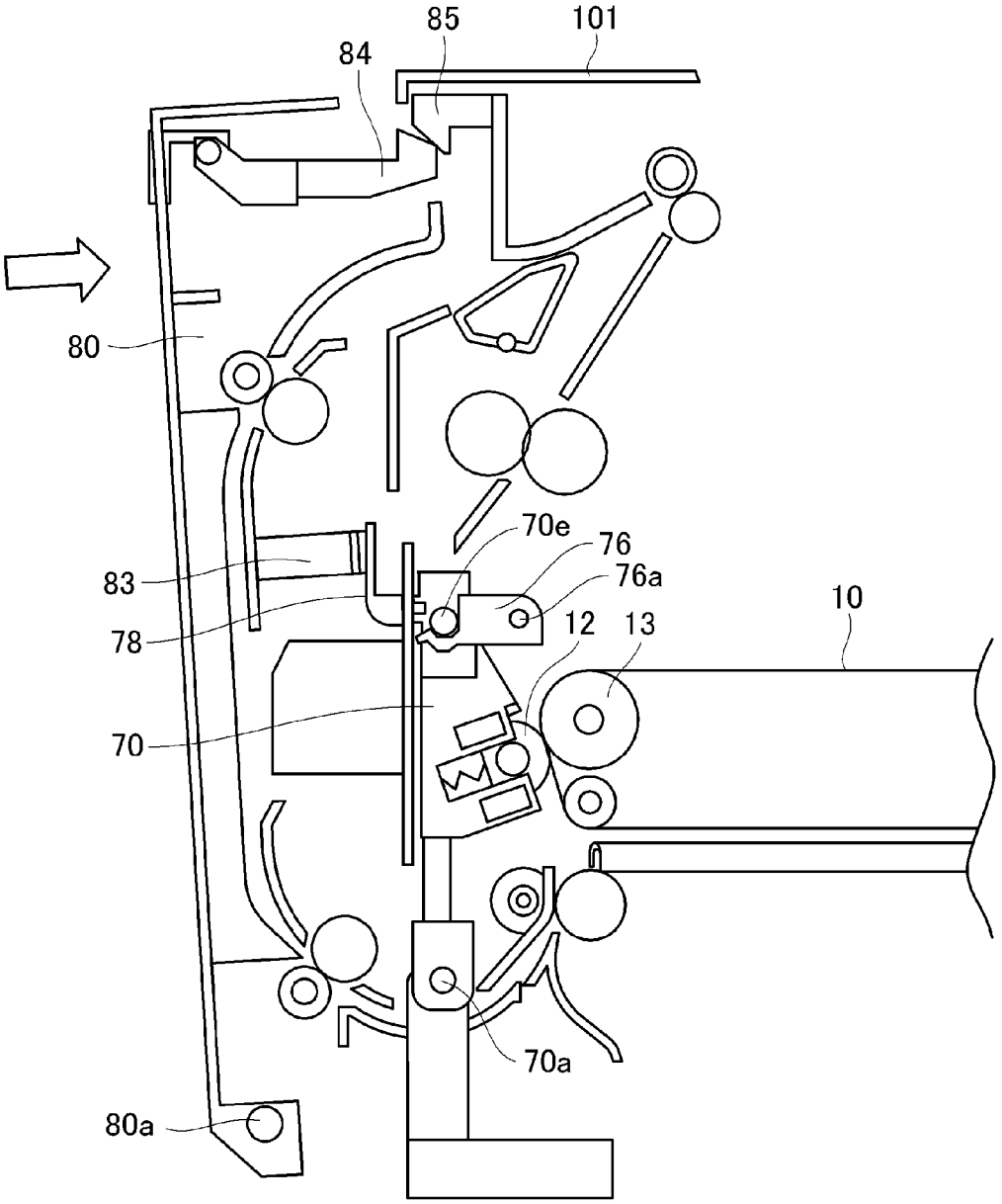
FIG. 12 is a schematic view showing a state in which the double-side-feeding unit is further closed from the state shown in FIG. 11.

Next, a closing operation of the double-side-feeding unit 80 and the secondary transfer unit 70 when the double-side-feeding unit 80 is closed in an open state of the double-side-feeding unit 80 and the secondary transfer unit 70 will be described with reference to FIGS. 11 and 12. FIG. 11 is a schematic view for illustrating an operation of each of the units when the double-side-feeding unit 80 is closed. FIG. 12 is a schematic view showing a state in which the double-side-feeding unit 80 is further closed from the state shown in FIG. 11.

When the double-side-feeding unit 80 is closed from the open state, an unshown cam-receiving surface of the secondary transfer unit 70 is urged against an unshown cam surface of the double-side-feeding unit 80 when a user pushes and closes the double-side-feeding unit 80. As a result, the secondary transfer unit 70 is closed in interrelation with the double-side-feeding unit 80. In view of an operation property such as jam clearance, a constitution in which in a state in which the double-side-feeding unit 80 is opened, only the secondary transfer unit 70 can be opened and closed is employed.

When the double-side-feeding unit 80 is closed from the open state and then reaches a predetermined angle, tapered claw portions 83*a* and 83*b* of the hooking claw 83 provided in the double-side-feeding unit 80 contact the lever 78 of the secondary transfer unit 70. When the double-side-feeding unit 80 is further closed from this state, the tapered claw portions 83*a* and 83*b* push the fixing lever 78 and thus perform an operation (rotating operation) for closing the secondary transfer unit 70. At this time, as shown in FIG. 11, by the stopping bosses 70*e* of the secondary transfer unit 70, the secondary transfer unit stopper 76 is pushed down in the counterclockwise direction against an urging force of an unshown spring. The hooking claws 83 are constituted similarly as in Embodiment 1, and therefore also in this embodiment, the positional deviation between the hooking claws 83 and the fixing lever 78 can be corrected, so that each of the tapered claw portions 83*a* and 83*b* can push the fixing lever 78 with the substantially same force.

When the double-side-feeding unit 80 is further closed, the tapered claw portions 83*a* and 83*b* of the hooking claws 83 push the fixing lever 78, whereby the secondary transfer unit 70 is pulled into a locking position (FIG. 12). At this time, the secondary transfer unit stopper 76 presses the stopping bosses 70*e* to prevent rotation of the secondary transfer unit 70, so that the secondary transfer unit 70 is locked by the apparatus main assembly 101 at both positions. At this time, the double-side-feeding unit 80 is not yet closed. When the double-side-feeding unit 80 is further closed, the hooking claws 83 deform and ride over the fixing lever 78. Thereafter, the lock 84 for double-side printing enters the lock receiving portion 85 for double-side printing, so that the rotation of the double-side-feeding unit 80 is prevented. As a result, the double-side-feeding unit 80 is locked by the apparatus main assembly 101 at both of the two portions.

Figure 13:
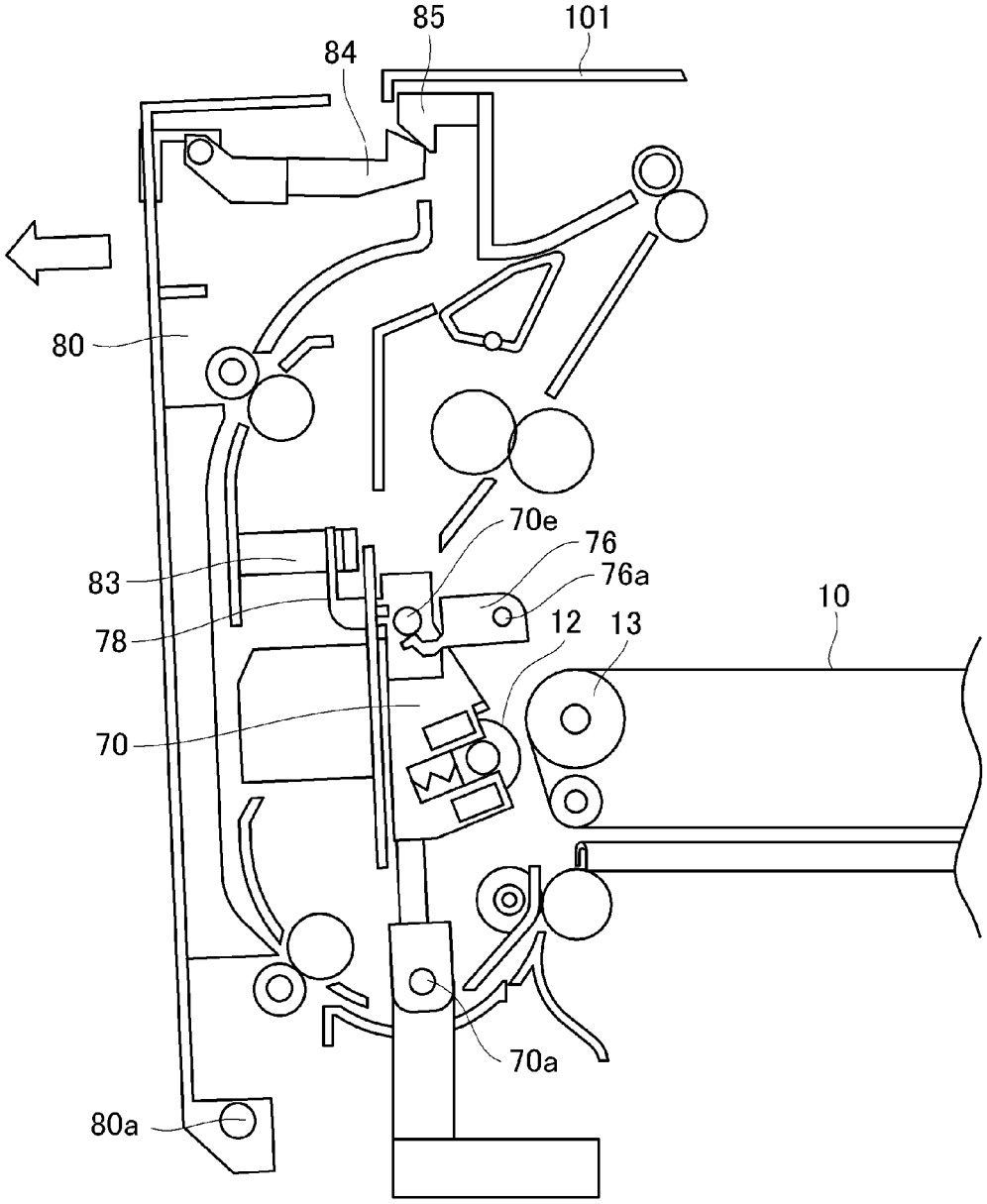
FIG. 13 is a schematic view showing a state in which the double-side-feeding unit is opened from a closed state.
Figure 14:
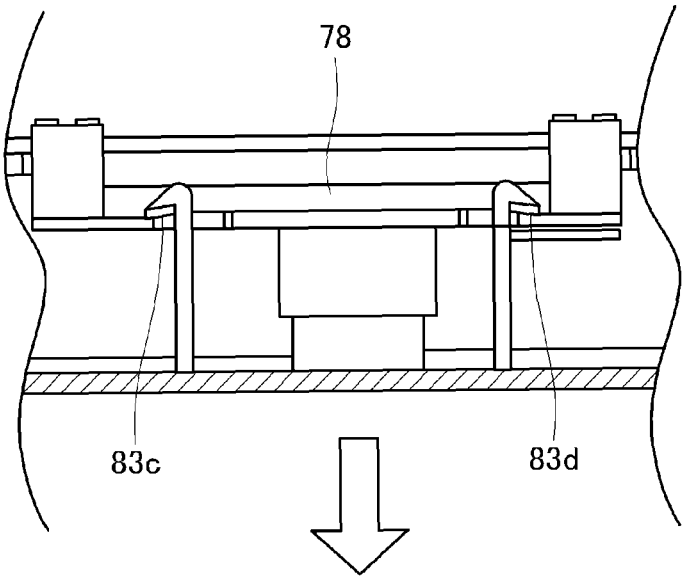
FIG. 14 is a schematic view of a portion in the neighborhood of a hooking claw in a state shown in FIG. 13 as seen from above.

Next, an opening operation of the double-side-feeding unit 80 and the secondary transfer unit 70 when the double-side-feeding unit 80 is opened from the closed state of the double-side-feeding unit 80 and the secondary transfer unit 70 will be described with reference to FIGS. 13 and 14. FIG. 13 is a schematic view showing a state in which the double-side-feeding unit 80 is opened from the closed state thereof. FIG. 14 is a schematic view of a portion in the neighborhood of the hooking claws 83 as seen from above in a state shown in FIG. 13.

When the lock of the double-side-feeding unit 80 is eliminated and thereafter is further opened, the hooking portions 83*c* and 83*d* of the hooking claws 83 pull the fixing lever 78 (FIGS. 13 and 14). As a result, the secondary transfer unit lock 76 is pushed down by the stopping bosses 70*e*, and thus the lock of the secondary transfer unit 70 is eliminated (FIG. 13).

When the double-side-feeding unit 80 is further opened, the fixing lever 78 disconnects from the hooking claws 83 due to a difference in rotation locus resulting from a difference in pivot between the double-side-feeding unit 80 and the secondary transfer unit 70. Thereafter, the secondary transfer unit 70 contacts the double-side-feeding unit 80 by its own weight in a manner such that the cam receiving surface (not shown) thereof contacts the cam surface (not shown) of the double-side-feeding unit 80, so that the secondary transfer unit 70 is opened in interrelation with the double-side-feeding unit 80.

As described above, also in this embodiment, an effect similar to that in Embodiment 1 can be obtained. Further, in this embodiment, a constitution in which the fixing lever 78 as the lever member is fixed is the secondary transfer unit 70 is employed, and therefore the cost can be reduced more than Embodiment 1 in which the lever member is constituted so as to be rotatable. However, when the lock of the secondary transfer unit 70 is released, in the constitution of the fixed lever member, an operating force larger than the operating force in the constitution of the rotatable lever member is needed, and therefore the constitution of the lever member may preferably be appropriately set depending on the specifications of the image forming apparatus.

According to the present invention, in the constitution in which the outside unit and the inside unit which are independently openable relative to the apparatus main assembly are provided, the inside unit can be engaged in the closed state with the apparatus main assembly with high reliability while realizing the cost reduction and the space saving.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 017337/2014 filed Jan. 31, 2014, which is hereby incorporated by reference.

What is claimed is:

1. An image forming apparatus comprising:

a main assembly;

a first unit openable about a rotational axis relative to said main assembly;

a second unit which is provided further inward than said first unit and which is openable relative to said main assembly; and an urging portion, provided in said first unit, for urging said second unit when a state of said second unit is changed from an open state to a closed state, wherein when said first unit is moved from an open state to a closed state, said urging portion causes said second unit to interrelate with movement of said first unit, and wherein said urging portion urges a central region of said second unit with respect to a direction of the rotational axis.

2. The image forming apparatus according to claim 1, further comprising two engaging portions, provided on said second unit, for placing said second unit in the closed state by engaging with said main assembly.

3. The image forming apparatus according to claim 2, wherein said urging portion urges two central sections when a region between said two engaging portions is divided into four equal sections.

4. The image forming apparatus according to claim 2, wherein said urging portion is disposed in each of one end side and the other end side in a substantially symmetrical manner on the basis of a center of said two engaging portions with respect to the direction of arrangement of said two engaging portions.

5. The image forming apparatus according to claim 2, wherein said urging portion includes a tapered portion inclined with respect to a movement direction thereof, and wherein the tapered portions are directed in a symmetrical manner with respect to a plane perpendicular to the direction of arrangement of said two engaging portions including the center of said two engaging portions.

6. The image forming apparatus according to claim 1, wherein said first unit includes a hooking member provided with said urging portion, and wherein said hooking member includes a hooking portion for opening said second unit by being hooked on said second unit placed in the closed state when said first unit is opened from the closed state.

7. The image forming apparatus according to claim 6, wherein said urging portion is provided closer to a free end side than said hooking portion when said first unit is closed from the open state.

8. The image forming apparatus according to claim 6, wherein said second unit includes:

a lever member provided movably relative to a main assembly of said second unit; and two engaging portions for placing said second unit in the closed state by engaging with said main assembly, wherein said lever member eliminates engagement of two engaging portions with the main assembly of said image forming apparatus when moved by being hooked on said hooking portion.

9. The image forming apparatus according to claim 1, wherein said first unit includes a part of feeding path for feeding a recording material when an image is formed on both surfaces of the recording material.

10. The image forming apparatus according to claim 1, wherein said second unit supports a transfer member for transferring onto a recording material a developer image formed on an image bearing member provided in said main assembly.

11. An image forming apparatus comprising:

a main assembly;

a first unit, openable about a rotational axis relative to said main assembly, including a part of a feeding path for feeding a recording material when image formation is effected on both surfaces of the recording material;

a second unit which is provided further inward than said first unit and which is openable relative to said main assembly; and an urging portion, provided in said first unit, for urging said second unit when a state of said second unit is changed from an open state to a closed state, wherein when said first unit is moved from the open state to the closed state, said urging portion causes said second unit to interrelate with movement of said first unit, and wherein said urging portion urges said second unit in a central region of a recording material feeding region of the feeding path with respect to a direction of the rotational axis.

12. The image forming apparatus according to claim 11, wherein said urging portion includes a tapered portion inclined with respect to a movement direction thereof.

13. The image forming apparatus according to claim 11, wherein said first unit includes a hooking member provided with said urging portion, and wherein said hooking member includes a hooking portion for opening said second unit by being hooked on said second unit placed in the closed state when said first unit is opened from the closed state.

14. The image forming apparatus according to claim 13, wherein said urging portion is provided closer to a free end side than said hooking portion when said first unit is closed from the open state.

15. The image forming apparatus according to claim 13, wherein said second unit includes a lever member provided movably relative to a main assembly of said second unit, and wherein said lever member eliminates a locked state of said second unit by the main assembly of said image forming apparatus when moved by being hooked on said hooking portion.

16. The image forming apparatus according to claim 11, wherein said second unit supports a transfer member for transferring onto a recording material a developer image formed on an image bearing member provided in said main assembly.

* * * * *